US011183357B2

(12) United States Patent
Jafari et al.

(10) Patent No.: US 11,183,357 B2
(45) Date of Patent: Nov. 23, 2021

(54) MBFEX TUBE

(71) Applicant: Cetteen GmbH, Forchheim (DE)

(72) Inventors: Houman Jafari, Erlangen (DE); Bo Gao, Forchheim (DE); Johannes Ringel, Gräfenberg (DE)

(73) Assignee: Cetteen GmbH, Forchheim (DE)

( * ) Notice: Subject to any disclaimer, the term of this patent is extended or adjusted under 35 U.S.C. 154(b) by 0 days.

(21) Appl. No.: 16/649,527

(22) PCT Filed: Sep. 20, 2018

(86) PCT No.: PCT/EP2018/025239
§ 371 (c)(1),
(2) Date: Mar. 20, 2020

(87) PCT Pub. No.: WO2019/057338
PCT Pub. Date: Mar. 28, 2019

(65) Prior Publication Data

US 2020/0312601 A1 Oct. 1, 2020

(30) Foreign Application Priority Data

Sep. 20, 2017 (DE) ..... 102017008810.1

(51) Int. Cl.
*H01J 35/12* (2006.01)
*H01J 35/06* (2006.01)
(Continued)

(52) U.S. Cl.
CPC ..... *H01J 35/13* (2019.05); *H01J 35/064* (2019.05); *H01J 35/065* (2013.01);
(Continued)

(58) Field of Classification Search
CPC ..... H01J 35/13; H01J 35/064; H01J 35/065; H01J 2235/068; H01J 2235/1204;
(Continued)

(56) References Cited

U.S. PATENT DOCUMENTS 4,264,818 A * 4/1981 Petersen ..... H01J 35/13 378/141
5,091,927 A * 2/1992 Golitzer ..... H01J 35/106 378/130

(Continued)

FOREIGN PATENT DOCUMENTS

DE 10164318 8/2002
DE 69821746 1/2005

(Continued)

OTHER PUBLICATIONS

Search Report mailed in PCT/EP2019/057338 dated Jun. 20, 2019.

(Continued)

*Primary Examiner* — Chih-Cheng Kao
(74) *Attorney, Agent, or Firm* — Laurence & Phillips IP Law

(57) ABSTRACT

A MBFEX tube (1) for an x-ray device comprises, in a vacuum tube (20), an anode (30) designed as a cooling finger and securely arranged in the vacuum tube, and a plurality of securely arranged cathodes (40, 41, 42), wherein the vacuum tube (20) comprises a plurality of cathode feed lines (50) and no more than two high-voltage bushings (51, 52), in a high-voltage bushing (52) a coolant pipe (31) is passed through by an internal coolant inner pipe (32), the coolant pipe (31) and the coolant inner pipe (32) are provided for cooling the anode (30) with a liquid coolant, the cathodes (40, 41, 42) are provided for field emission of electrons and are arranged on the anode (30) for generating x-ray sources (Q).

25 Claims, 17 Drawing Sheets

(51) Int. Cl.
*H01J 35/14* (2006.01)
*H01J 35/10* (2006.01)

(52) U.S. Cl.
CPC ..... *H01J 35/106* (2013.01); *H01J 35/147* (2019.05); *H01J 2235/023* (2013.01); *H01J 2235/062* (2013.01); *H01J 2235/068* (2013.01); *H01J 2235/1204* (2013.01); *H01J 2235/1262* (2013.01); *H01J 2235/1275* (2013.01)

(58) Field of Classification Search
CPC ..... H01J 2235/1262; H01J 2235/1275; H01J 2235/023; H01J 2235/062
See application file for complete search history.

(56) References Cited

U.S. PATENT DOCUMENTS

| | | | | |
|---|---|---|---|---|
| 5,596,621 | A * | 1/1997 | Schwarz | H01J 35/00 378/130 |
| 7,751,528 | B2 | 7/2010 | Zhou et al. | |
| 2003/0072407 | A1 | 4/2003 | Mihara et al. | |
| 2013/0345620 | A1 | 12/2013 | Zemel | |
| 2015/0078510 | A1* | 3/2015 | Tang | H05G 1/10 378/9 |
| 2015/0124934 | A1 | 5/2015 | Gupta et al. | |
| 2016/0331989 | A1 | 11/2016 | Cho et al. | |
| 2017/0290135 | A1* | 10/2017 | Shimizu | H05G 1/025 |
| 2018/0221517 | A1 | 8/2018 | Trutwig | |

FOREIGN PATENT DOCUMENTS

| | | | |
|---|---|---|---|
| DE | 102010011661 | | 9/2011 |
| DE | 102011076912 | | 6/2012 |
| DE | 102010043561 | | 10/2012 |
| DE | 102014013716 | | 3/2016 |
| EP | 2851929 | | 3/2015 |
| GB | 2551890 | | 1/2018 |
| JP | H06162974 | A | 6/1994 |
| JP | 2003234059 | A | 8/2003 |
| JP | 2017510051 | A | 4/2004 |
| JP | 2004214203 | A | 7/2004 |
| JP | 2007123280 | A | 5/2007 |
| JP | 2011181517 | A | 9/2011 |
| JP | 2016033922 | A | 3/2016 |
| JP | 2016058360 | A | 4/2016 |
| JP | 2016536764 | A | 11/2016 |
| JP | 2017510051 | A | 4/2017 |
| WO | 2005/117058 | | 12/2005 |
| WO | 182384 | | 11/2016 |
| WO | 2018/086737 | | 5/2018 |
| WO | 2018/086744 | | 5/2018 |
| WO | 094304 | | 8/2019 |

OTHER PUBLICATIONS

Written Opinion mailed in PCT/EP2019/057338 dated Jun. 20, 2019.
PCT/EP2018/025239, International Search Report, dated Feb. 26, 2019.
PCT/EP2018/025239, Written Opinion, dated Feb. 26, 2019.
PCT/EP2018/025239, International Preliminary Report on Patentability, dated Mar. 24, 2020.
Yang Lu, Hengyong Yu, Guohua Cao, Jun Zhao, Ge Wang, Otto Zhou, Medical Physics 2010, Band 37, S. 3773-3781.
Japanese Patent Application No. 2020-515101, Reasons for Refusal, dated Jul. 6, 2021.
Japanese Patent Application No. 2020-515101, Reasons for Refusal (translation), dated Jul. 6, 2021.
Japanese Patent Application No. 2020-515101, Written Opinion, dated Aug. 11, 2021.
Japanese Patent Application No. 2020-515101, Written Opinion (translation), dated Aug. 11, 2021.
Japanese Patent Application No. 2020-515101, Amendment, dated Aug. 11, 2021.
Japanese Patent Application No. 2020-515101, Amendment (translation), dated Aug. 11, 2021.

* cited by examiner

MBFEX TUBE

The present application claims priority to German Patent Application No. 102017008810.1, filed on Sep. 20, 2017, and International Application No. PCT/EP2018/025239 filed on Sep. 20, 2018, titled "MBFEX Tube," and assigned to the assignee of the present invention. German Patent Application No. 102017008810.1 and International Application No. PCT/EP2018/025239 are incorporated by reference herein.

BACKGROUND

The invention relates to a device for controlling an X-ray tube and a method for operating an X-ray tube.

The invention relates to a MBFEX tube (MBFEX=Multibeam Field Emission X-Ray) for an x-ray device, which is also referred to as multiple focus field emission x-ray tube.

Such x-ray tubes are known, for example, from the treatise: Yang Lu, Hengyong Yu, Guohua Cao, Jun Zhao, Ge Wang, Otto Zhou, *Medical Physics* 2010, Volume 37, pp. 3773-3781 and from U.S. Pat. No. 7,751,528 B2, wherein the cathodes contain carbon nanotubes for field emission of electrons. The MBFEX tubes described therein are provided for use in computer tomographs, in which instead of a rotation of an x-ray emitter, sequential electric switchings of individual x-ray emitters in a fixed arrangement are carried out.

Regarding electron emitters containing nanorods, in particular carbon nanotubes, reference is made to documents WO 2018/086737 A1 and WO 2018/086744 A2, for example.

Various MBFEX tubes described in U.S. Pat. No. 7,751,528 B2 comprise x-ray emitters in a fixed arrangement, in which emitters a cathode is associated with an anode in each case. Thus, overall, a plurality of cathodes and a corresponding plurality of anodes are present. While the anodes are at a high direct current voltage potential, the cathodes are to be actuated individually.

The aim of the invention therefore is to provide a MBFEX tube which is easy to produce in terms of production technology and compact in terms of technical design in comparison to the prior art.

This aim is achieved according to the invention by the proposed MBFEX tube having the features of Claim 1. Furthermore, the aim is achieved by an arrangement of multiple MBFEX tubes according to Claim 27. The MBFEX tube can be produced according to Claim 28 and operated according to Claim 30.

The proposed MBFEX tube is provided for an x-ray device and comprises, in a vacuum tube, and an anode securely arranged therein and designed as a cooling finger, and a plurality of cathodes securely arranged in a row. The vacuum tube in turn comprises a plurality of cathode feed lines and no more than two high-voltage bushings. Here, in a high-voltage bushing, a coolant pipe is arranged in which an additional pipe, that is to say a coolant inner pipe, is arranged. Here, either the external or the internal pipe can function as a coolant feed pipe, wherein the respective other pipe is provided as coolant discharge pipe.

The coolant feed pipe and the coolant discharge pipe are provided for cooling the anode with a liquid coolant. The cathodes are provided for field emission of electrons and are in each case oriented with respect to their main electron emission direction toward the common anode for the generation of x-ray sources. The x-ray sources on the anode emit x-ray beams which each have a main x-ray emission direction. The x-ray sources are arranged on the anode preferably in a row arrangement.

The first underlying inventive idea of the invention for solving the problem of cooling the anode which is associated with the MBFEX tubes according to the prior art, is to design the anode of the proposed MBFEX tube itself as cooling device in the form of a cooling finger. For this purpose, in the proposed MBFEX tube, the anode is designed to be hollow, wherein the hollow space has a double-shell design in order to enable both the feed and also the discharge of coolant. For example, the inner pipe is the coolant feed pipe and the outer pipe concentrically surrounding the inner pipe is the coolant discharge pipe.

The anode including the coolant pipes is closed at one end. At this end of the elongate anode, the transition between the coolant feed pipe and the coolant discharge pipe is formed. Suitable liquid coolants include low-viscosity silicone oils, particularly those having a boiling point of more than 450° C. Insulating oils marketed under the trade name "Shell Diala" can also be used as coolant for cooling the anode.

The design of the anode as a cooling finger not only corresponds to a particularly advantageous compact design, but also has the disadvantage that both the coolant discharge pipe and also the coolant feed pipe can be connected at one of the two ends of the anode by a passage through the vacuum tube to a coolant circulating device.

The anode contains molybdenum and/or tungsten, for example and optionally comprises a coating suitable for the emission of x-rays on the outer surface. According to an advantageous development, surface sections of the anode, which are slanted with respect to the elongate base form, are formed by projections of the anode. Here, the individual projections have different slant angles with respect to the elongate base body of the anode. In this manner, it is possible with particularly high efficiency to orient the x-ray radiation generated on the individual projections by incident electrons in the direction of the isocenter of the x-ray installation comprising the MBFEX tubes. This result can also be achieved in that the mentioned surface sections are ground in the anode. A coating of the anode can be located either on its entire surface or only on sections of the surface, namely on the projections or in the ground sections.

The anode of the x-ray tube is preferably designed as a nonrotating anode. In order to further improve the cooling, a rotation of the anode about its own axis can in principle also be provided.

The production of small bushings through a vacuum tube for x-ray devices can be achieved using a simple production technology with regard to the sealing from the outside atmosphere. The cathode feed lines of the proposed MBFEX tubes are provided as connections of the cathodes to an electric voltage, typically of a magnitude of a few kV, in particular up to 4 kV, and are designed, for example, as wire feed lines. For example, if the vacuum tube is made of glass, the cathode feed lines in the form of wires can simply be melted into the vacuum tubes, wherein such bushings have high and long-lived impermeability.

Larger bushings, on the other hand, for example for high-voltage electric connections or for pipes in a vacuum tube, require elaborate sealing. Therefore, it is advantageous to avoid a large number of such larger bushings on a vacuum tube. According to a second basic inventive idea, this is achieved in the proposed MBFEX tube in that the coolant discharge pipe together with the coolant feed pipe is passed through a high-voltage bushing. The high-voltage bushings are provided for the connection of the anode to a high electric voltage. The connection of the anode to a high voltage occurs preferably in each case at an end on said anode.

Between the cathodes and the anode, focusing electrodes are arranged in a fixed arrangement in the vacuum tube, which can be connected, for example, via electric feed lines in the cathode feed lines to an electric voltage. The focusing electrodes are located in the space between extraction grids which are spaced at a small distance from the cathodes, and the anode.

Structures of the extraction grid can be produced particularly precisely by laser machining. In particular, a picosecond or femtosecond laser is suitable for structuring the extraction grid. The precise production of the extraction grid is an essential prerequisite for ensuring that electrons emitted in a flat pattern by the cathode reach the anode with a high transmission degree. During the operation of the MBFEX tube, the electron source including the electron grid is exposed to thermal stresses inter alia. In order to minimize the deformation of the extraction grid due to these stresses, a special design of the extraction grid is preferably implemented:

The extraction grid in principle has a base form adapted to the form of the associated electron source, that is to say the cathode, in particular a rectangular base form. The long sides of this rectangle are formed by so-called edge strips of the extraction grid. The two edge strips are connected to one another to form a single piece by grid strips extending transversely to said edge strips. For the absorption of thermally caused deformations, the transition regions between the grid strips and the edge strips are of particular importance. A curved transition between grid strips and edge strips has been found to be particularly advantageous. Here, the curvatures at the two ends of the grid strips are preferably oriented in opposite directions. For example, if, in top view onto the extraction grid, one end of the grid strip is curved upward at its transition to the edge strip, then the other end of the grid strip is curved downward at the transition to the opposite edge strip. The grid strips thus each have an elongate S form, wherein the spacing between the individual grid strips is at least approximately constant over their entire length. Each grid strip here encloses a non-right angle with the edge strip. Instead of an elongate S form of the grid strip, said grid strip can also have another form suitable for length compensation. For example, in each grid strip, in particular close to the transition regions to the edge strips, arcuate, in particular semicircular curved sections can be integrated. It is also possible to design sections of the grid strips with simple or Z-shaped angles, preferably of rounded form. In all cases, the spacing between adjacent grid strips is preferably constant over the entire length of the grid strips.

The spacing between each point of the extraction grid and the electron emitter is constant with very good approximation not only in the cold state of the MBFEX tube but also during operation according to intended use. In addition to the extraction grid, components of the focusing device can also be machined precisely with pulsed laser radiation. The extraction grid, like the focusing components, can also be produced, for example, from steel, in particular stainless steel.

The x-ray beams which can be generated at the x-ray sources on the anode each have a direction with the maximum intensity of the emitted x-ray radiation, which corresponds to the respective main x-ray emission direction. Such a main x-ray emission direction exists in all x-ray sources that are different from a spherical beam source. The geometry of the x-ray beam acquired by the x-ray detector depends not only on the focusing of the electron beam but also on the collimation of the x-ray radiation. Here, an x-ray window can be designed in the vacuum tube as a collimator device and/or a collimator can be attached in front of an x-ray window on the vacuum tube.

By means of the MBFEX tube, for example, fan-shaped x-ray beams (fan beam) and/or cone-shaped x-ray beams (cone beam) can be generated. Each individual x-ray source of the x-ray sources formed on the anode can be, for example, approximately in the shape of a point, in the shape of a plane, or in the shape of a line. The cross section profile of the x-ray radiation in the isocenter of the x-ray installation, in particular tomography installation, depends not only on the form of the x-ray source but above all on the collimation of the x-ray radiation.

In the proposed MBFEX tube, the cathodes are preferably arranged in a row in a fixed arrangement in such a manner that, in cooperation with the focusing electrodes on the anode, a row arrangement of x-ray sources is also generated. The cathodes are provided for a sequential electric actuation. In a computer tomograph, the proposed MBFEX tube can be used instead of a rotating x-ray source.

Below, individual advantageous developments of the proposed MBFEX tube are discussed.

In a preferred embodiment of the MBFEX tube, the high-voltage bushings and the cathode feed lines are arranged in a row and lie opposite the anode on the vacuum tube. This means that—viewed in the cross section of the MBFEX tube—the cathode feed lines and the high-voltage bushings, on the one hand, and the anode, on the other hand, are diametrically opposite one another. By means of such an arrangement, the high-voltage bushings and the cathode feed lines are exposed only to a minimum of radiation of secondary electrons or ions. Particularly advantageously, such an arrangement also enables an easily achieved installation of the proposed MBFEX tube in an x-ray device, for example, in the gantry of a computer tomograph.

In a preferred design of the proposed MBFEX tube, cathodes thereof comprise carbon nanotubes. The very high electric and thermal conductivity of carbon nanotubes enables a high current conducting capacity without significant heat development onto the individual carbon nanotubes themselves. Carbon nanotubes have a low field strength threshold value of less than 2 V/m for the field emission of electrons. The field strength threshold value in cathodes for the emission of electrons, which comprise carbon nanotubes, can be lowered even further in that the carbon nanotubes are arranged in a perpendicular preferential direction on the cathode surface. Since single-walled carbon nanotubes represent semiconductors and since multi-walled carbon nanotubes represent metallic conductors, multi-walled carbon nanotubes are particularly suitable for applications as electron emitters on the cathodes of the proposed MBFEX tube. Therefore, the operation of the proposed MBFEX tube which comprises cathodes containing carbon nanotubes can be achieved particularly advantageously with a current supply of relatively low power.

In addition to carbon nanotubes, nanorods of another type, generally referred to as nanosticks, are also suitable for the emission of electrons within the MBFEX tube. In a preferred design, field emission cathodes as cathodes of the x-ray tube are formed from such nanosticks.

The nanosticks of the cathodes are preferably produced from a material which provides, with regard to the quantum mechanical field emission effect, a lowest possible electron work function for the field emission of electrons. The nanosticks here have uniform or non-uniform composition and are designed either as hollow bodies, that is to say tubes, or they are solid. The cathodes can here comprise nanosticks of identical type or a mixture of different types of nanosticks, wherein the type of the nanosticks relates to their substance composition and substance modification.

Suitable materials in pure or doped form for field emission of electrons are, in addition to single- or multi-walled carbon nanotubes, also single- or multi-walled hetero nitrogen carbon nanotubes, rare earth borides, in particular lanthanum hexaboride and cerium hexaboride, metal oxides, in particular $TiO_2$, MnO, ZnO and $Al_2O_3$, metal sulfides, in particular molybdenum sulfide, nitrides, in particular boronitride, aluminum nitride, carbon nitride, gallium nitride, carbides, in particular silicon carbide, silicon. Rod-shaped, optionally hollow elements made from polymer materials are also suitable as starting products for producing nanosticks which emit electrons during the operation of the cathodes. The nanosticks of the cathodes are optionally produced from starting products which only partially comprise polymer materials, in particular in the form of a coating.

In a particularly preferred design, the cathodes have nanosticks on the surface in a perpendicular preferential direction, that is to say in the direction of the anode. During the operation of the x-ray emitter and in the case of sufficient mutual spacing, very strong electrical fields can be generated at the tips of the nanosticks, whereby the emission of electrons is considerably facilitated.

In a possible embodiment of the proposed MBFEX tube, more than one type of cathode is arranged in the vacuum tube, wherein the term "type" can relate both to the geometry and also to other properties of the cathodes, for example, to the materials. Cathodes of identical or different type can in principle be electrically actuated sequentially in any desired manner. In addition to the cathodes themselves, there can also be differences with regard to the focusing. In combination with the properties such as the surface geometry of the individual cathodes, different electron beams and in the end different x-ray beams can thus be generated.

The nanorods of the cathode, for example, have a length of less than 20 μm and a diameter of less than 10 nm, resulting in a density with respect to the surface area of the cathode of at least $10^6$ nanorods per $cm^2$.

For producing cathodes containing nanorods, a silk screen printing method is suitable. Here, in comparison to conventional methods, in particular in comparison to electrophoretic deposition (EPD) methods, a particularly uniform layer density as well as a relatively smooth surface of the emitter can be achieved. Preferably, a layer designed for the emission of electrons which has a density of less than 20 μm and an average roughness (Ra) of less than 2.5 μm is formed by at least one type of cathode. The high quality of the emitter layer together with a constant spacing with respect to the extraction grid contributes to a high transmission rate of the electron source of the x-ray tube of up to 90% and more. The high transmission rate is also promoted by the preferential orientation of the nanotubes in perpendicular direction with respect to the substrate surface on which the emitter layer is located, which is brought about by the silk screen printing method.

It is also possible, within one and the same MBFEX tube, to use both cathodes with carbon nanotubes and completely different cathodes, for example, cathodes with tungsten tips which work in another manner known in principle. Dispenser cathodes can also be used within the MBFEX tube. In this context, reference is made to the documents DE 10 2011 076 912 B4 and DE 10 2010 043 561 A1.

To the extent that cathodes are designed as field emission cathodes, the complete emitter arrangement preferably has the following layered structure:

As the lowermost layer of the emitter arrangement, a flat support element, in particular in the form of a ceramic plate, is provided. The ceramic plate is produced from corundum, for example. The emitter layer is located on the ceramic plate. In regions adjacent to the flat emitters, the ceramic plate is covered by a metal intermediate plate referred to as spacer. On the metal intermediate plate which is at a defined electric potential, a so-called grid plate including the extraction grid associated with the individual emitters is located. The grid plate in turn is covered by a plate made of an electrically insulating material, in particular a ceramic, which is referred to in general as upper insulating layer. The term "upper" layer here has nothing to do with the orientation of the electron emitter in space, but merely means that the mentioned layer is arranged closest to the anode of the x-ray tube. The described layered structure is also suitable for other x-ray tubes not claimed as a whole.

In a particularly preferred development of the proposed MBFEX tube, the anode at least partially encloses a designated examination region. Here, the x-ray sources and the main x-ray emission directions also at least partially enclose the examination region. The examination region is provided for positioning an examination object in an x-ray device.

For example, the MBFEX tube as a whole is curved, whereby, as an individual x-ray tube, it already partially encloses the examination region. A further enclosing of the examination region can be implemented in different ways: For example, the MBFEX tube can extend over a very large angle, in the extreme case up to approximately 360°; that is to say it can have an approximately closed annular form. Alternatively, it is possible to compose an annular form from individual MBFEX tubes. Each individual MBFEX tube here can itself be either curved or straight. In the last-mentioned case, the result is a polygonal form of the arrangement consisting of all the MBFEX tubes. Incomplete polygonal forms or annular forms, for example, L-shaped, U-shaped or semicircular forms, can also be produced by combining multiple MBFEX tubes, wherein all the MBFEX tubes of such arrangements do not necessarily have to be of identical form.

By means of an arcuate anode of the MBFEX tube, arranged in a concave manner around the examination region, the low focal spot resolution can be improved in a computer tomograph in comparison to conventional designs, and a higher as well as constant image resolution can be achieved, in particular when the anode is designed as a circular arc. If the anode is designed as a circular arc, then all the x-rays are oriented in the same way toward an examination object. By minimizing the number of high-voltage bushings, inter alia, the examination object can be x-rayed from practically all the peripheral positions by means of a single MBFEX tube.

The proposed MBFEX tube is characterized by a compact and robust design which is particularly easy to implement in terms of manufacturing technology in comparison to the prior art and is particularly suitable for computer tomographs as a replacement for a rotating x-ray source. The vacuum tube in which the x-ray radiation is generated is preferably produced from metal.

By means of cathodes of different type, which are arranged in one and the same MBFEX tube, different x-ray photographs which differ from one another by the dose can be generated in a simple manner. Thereby, a simple possibility of a dose modulation is provided. The number of the MBFEX tubes present in an x-ray installation, just as the form of the individual MBFEX tubes as well as the geometric arrangement of the MBFEX tubes in relation to one another, is not subject to any limitations in principle. In the same way, the MBFEX tube or a plurality of MBFEX tubes can be combined within an x-ray installation with x-ray tubes of another design. In general, x-rays of different wavelengths, as provided for multi-energy or dual-energy imaging, can be generated by different settings of the anode voltage.

Independently of the design of the cathodes, by means of the MBFEX tube, in a preferred procedure, successive x-ray pulses of different wavelength can be generated. Thus, different materials within the examination volume can be distinguished from one another with a particularly high reliability and at the same time a short shooting duration.

In order to achieve a low susceptibility to disturbances and to prevent or at least minimize damage, in the case of possible disturbances, it has been found to be particularly advantageous to ground different components of the MBFEX tube to be set to zero potential in a different manner. Specifically this relates to focusing electrodes as well as to the extraction grid located immediately in front of the electron emitters which contain carbon nanotubes or other nanosticks:

While passive focusing electrodes are grounded via a housing in a preferred design, the grounding of the extraction grid occurs independently of said housing, for example, via a separate grounding line which can be associated with a unit for actuating the electron emitters.

The advantage of the separate grounding of focusing electrodes and extraction grid applies if, due to arcing, the potential of the focusing electrodes is briefly raised—in spite of the presence of grounding —, due to the very high potential applied to the anode. If, at that time, the extraction grid were grounded together with the focusing electrodes, then this would result in a corresponding elevated potential of the extraction grid and thus an elevated voltage difference between the carbon nanotubes and the extraction grid. Due to the existing very pronounced voltage dependency of the electron emission of the carbon nanotubes, the electron emission would as a result increase in a extreme manner, which would entail the risk of damaging the x-ray tube. Such a risk of damage is avoided by the separate grounding of focusing electrodes, on the one hand, and of extraction grid, on the other hand.

BRIEF DESCRIPTION OF SEVERAL VIEWS OF THE DRAWINGS

Below, the proposed MBFEX tube is explained in further detail in reference to drawings in which different embodiments are summarized. In the drawings, in part in a roughly simplified representation.

LIST OF SYMBOLS

Figure 1:
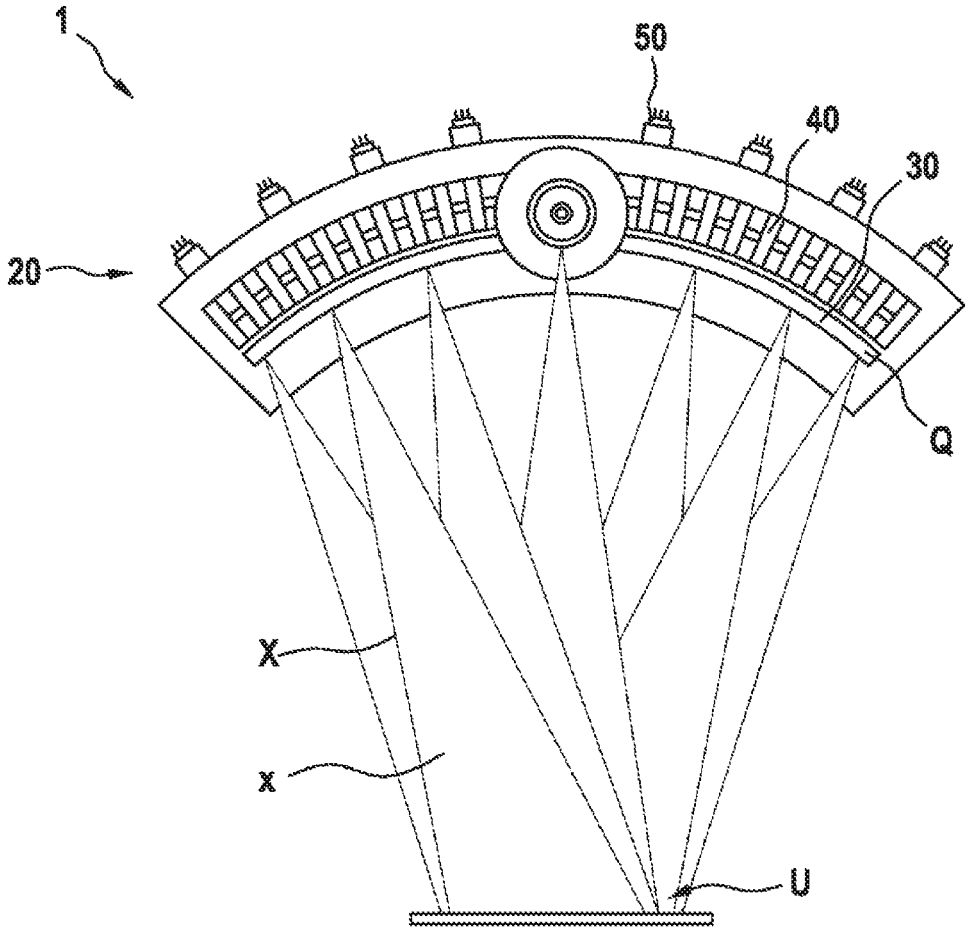
FIG. 1 shows a first embodiment example of a MBFEX tube 1 in a diagrammatic view onto an anode 30 formed as a circular arc.

1 MBFEX tube
6 Support Transformer
10 X-ray arrangement
20 Vacuum tube
21 X-ray window
30 Anode
31 Coolant discharge pipe
32 Coolant feed pipe
33 Projection
34 Surfaces
40 Cathode
41 Cathode
42 Cathode
43 Grid device
44 Emitter arrangement
45 Ceramic plate
46 Intermediate plate
47 Grid plate
48 Upper insulating layer
49 Opening
50 Cathode feed line
51 High-voltage bushing
52 High-voltage bushing
61 Rectangular opening
62 Strip-shaped opening

63 Connection strip
64 Opening
65 Opening
66 Conductor structures
71 Extraction grid
72 Focusing electrode
73 Extraction grid electrode
74 Extraction grid electrode
75 Focusing electrode
76 Focusing electrode
77 Grid strip
78 Edge strip
79 Transition region
80 Ceramic support
81 Metal layer
AC Anode current
E Electron beam
e Main electron emission direction
EC Emitter current
GEV Grid emitter voltage
Q X-ray source
X X-ray beam
x Main x-ray emission direction
U Examination region

DETAILED DESCRIPTION

All the embodiment examples of the proposed MBFEX tube 1 explained below are provided for a computer tomograph and comprise a vacuum tube 20 with an x-ray window 21. In the vacuum tube 20 of all the embodiment examples, an anode 30 designed as a cooling finger is securely arranged. The anode 30 contains tungsten.

Figure 21:
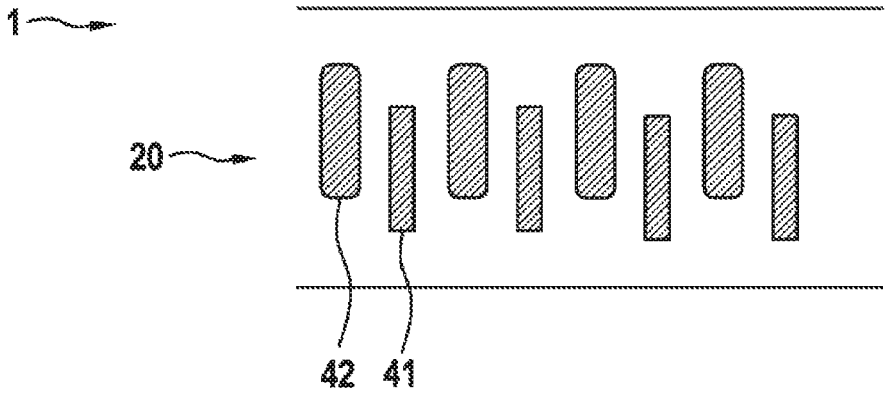
FIG. 21 shows a detail of a MBFEX tube 1 with two different types of cathodes 41, 42.
Figure 22:
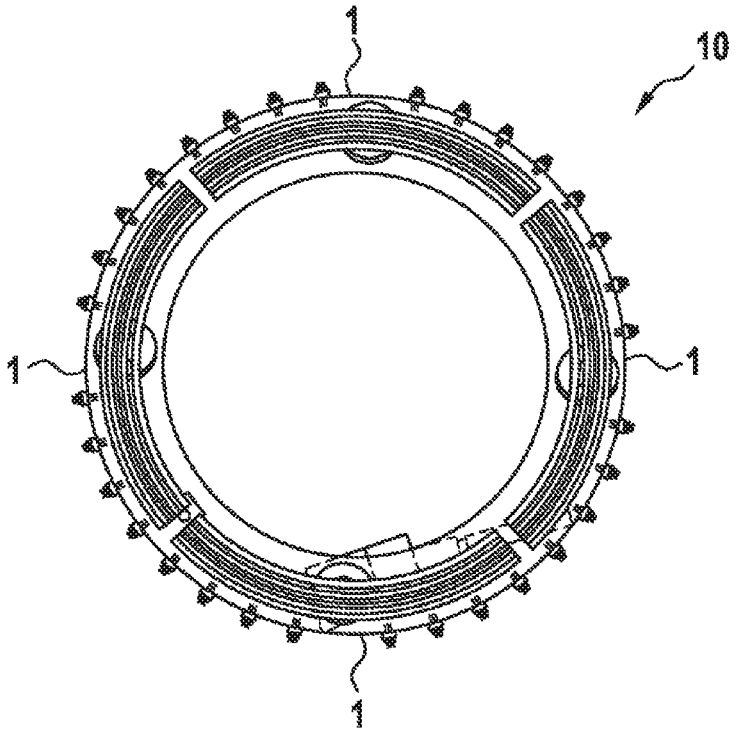
FIGS. 22, 23 show an example of an overall annular arrangement of multiple MBFEX tubes 1 in two different views.
Figure 23:
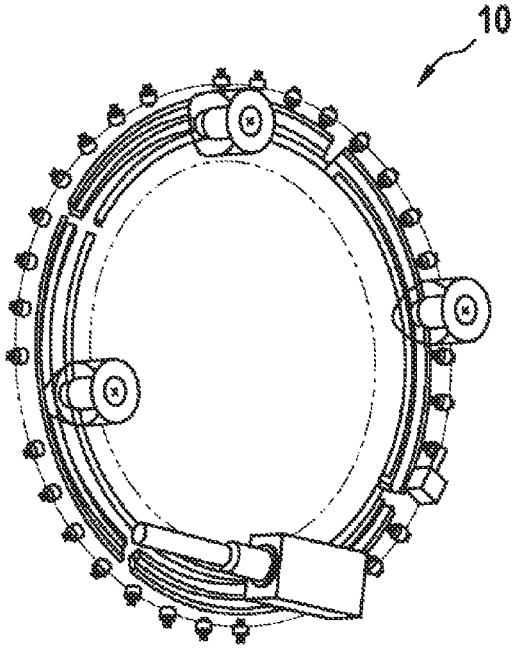
Figure 24:
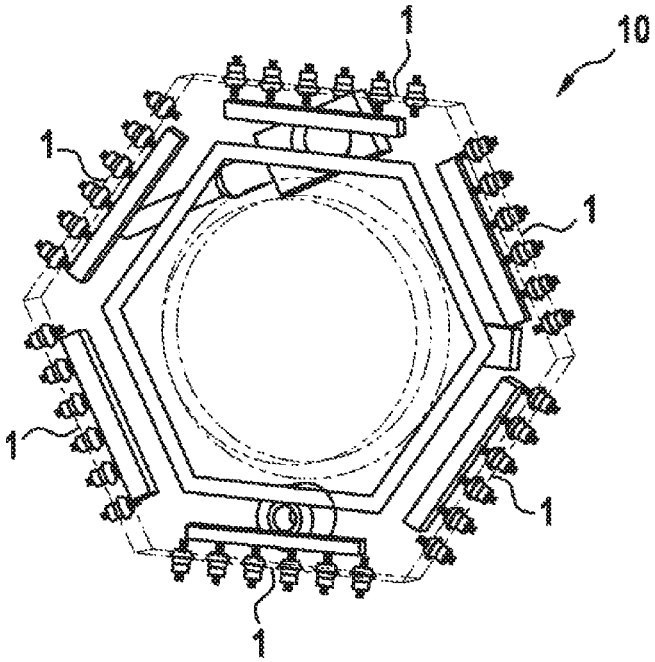
FIGS. 24, 25 show an example of an overall polygonal arrangement of multiple MBFEX tubes 1 in two views analogous to FIGS. 22 and 23, FIGS. 26, 27 show an anode 30 of a MBFEX tube 1, comprising multiple projections 33, each functioning as x-ray source.
Figure 25:
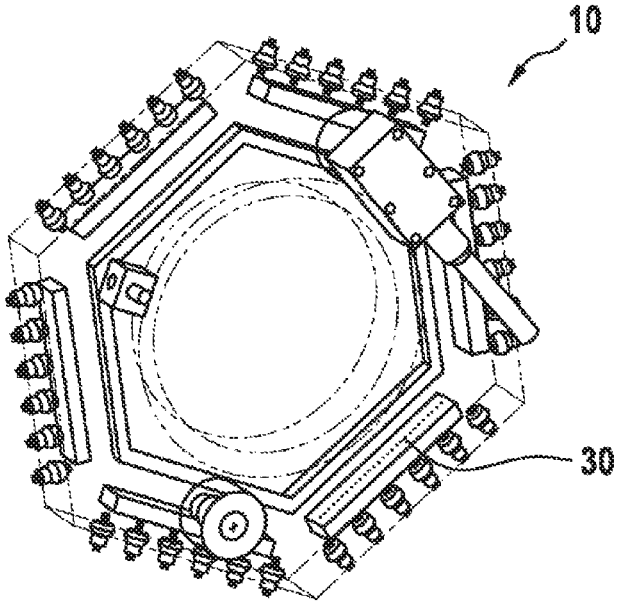

The first two embodiment examples of the proposed MBFEX tube comprise, in the vacuum tube 20, a plurality of cathodes 40 of a uniform type arranged in a row arrangement, and the embodiment example according to FIG. 21 comprises such cathodes 41, 42 of two different types, wherein the cathodes 40, 41, 42 are provided for field emission of electrons. The cathodes 40, 41, 42 are each oriented with respect to the main electron emission direction e of the electron beams E which can be generated toward the common anode 30 for generating x-ray sources Q The cathodes 40, 41, 42 are securely arranged in a row arrangement in such a manner that an arrangement of x-ray sources Q which is also in a row arrangement, can be generated on the anode 30. The cathodes 40, 41, 42 are provided for a sequential electric actuation. The x-ray beams X each have a main x-ray emission direction x.

In all the embodiment examples, in each case a grid device 43 is oriented toward each x-ray source Q The grid devices 43 are securely arranged between the cathodes 40, 41, 42 and the anode 30 in the vacuum tube 20. Each grid device 43 comprises an extraction grid. The extraction grids are arranged with small spacing in front of the cathodes 40, 41, 42 and are provided for extraction of electrons in the form of an electron beam E from the cathodes 40, 41, 42. The extraction grids are not drawn in the FIGS. 1 to 4.

The vacuum tube 20 of all the embodiment examples in turn comprises a plurality of cathode feed lines 50 and two high-voltage bushings 51, 52. The cathode feed lines 50 are provided as connections of the cathodes and of the grid devices 43 for an electric voltage of a few kV and are designed as wire feed lines. The high-voltage bushings 51, 52 are provided for the respective end-side connection of the anode to a high electric voltage of several 10 kV. Typically, the high voltage is in the range of 10 kV to 420 kV. Values in the upper range of this interval are selected, for example, for x-ray installations for examining large objects in the non-medical sector.

In a high-voltage bushing 52, a coolant discharge pipe 31 is passed through by an internal coolant feed pipe 32. The coolant discharge pipe 31 and the coolant feed pipe 32 are provided for cooling the anode 30 with a liquid, electrically non-conductive coolant by means of a circulation device.

Figure 29:
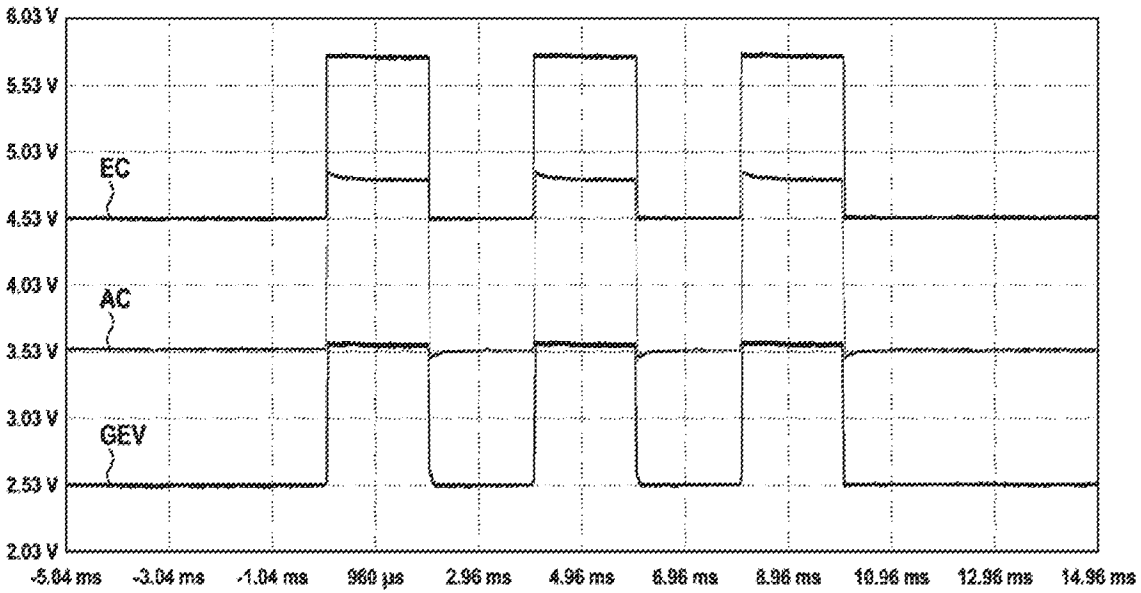
FIG. 29 shows, in a diagram, current and voltage pulses during the operation of the MBFEX tube 1.

In all the embodiment examples of the proposed MBFEX tube 1, by means of the cathodes 40, 41, 42, in cooperation with the anode 30, x-ray pulses of uniform or alternatingly varying energy can be generated. For example, in FIG. 29, the temporal course of the emitter current EC, of an anode current AC, and of the grid emitter voltage GEV is drawn. The diagram according to FIG. 29 shows actual measurement data. The high transmission degree of approximately 90%, which indicates the ratio of anode current AC to emitter current EC, should be emphasized. In the present case, the anode current AC determined from the measured voltage values is 52.2 mA, and the emitter current EC is 58.2 mA. This extremely favorable ratio between anode current AC and emitter current EC results essentially from the high quality of the emitter arrangement 44 of the x-ray tube 1 to be explained in further detail below.

The first embodiment example of the proposed MBFEX tube 1 is explained in further detail below in reference to FIG. 1 and FIG. 2. In the first embodiment example, the anode 30 is designed as a circular arc.

FIG. 1 shows a diagrammatic view onto the anode 30, wherein the vacuum tube 20, the grid devices 43 and the high-voltage bushings 51, 52 cannot be seen. FIG. 1 is not true to scale. The anode 30, the cathodes 40 and the grid devices 43 are arranged within the vacuum tube 20. Here, the cathodes 40 are on a support 6 made of metallized ceramic. The anode 30 is fastened independently of the cathodes 40 in the vacuum tube 20. The x-ray sources Q are arranged so that the x-ray beams X generated are oriented in their respective main x-ray emission directions x toward an examination region U.

The examination region U is provided for positioning an examination object, in particular a patient.

Figure 2:
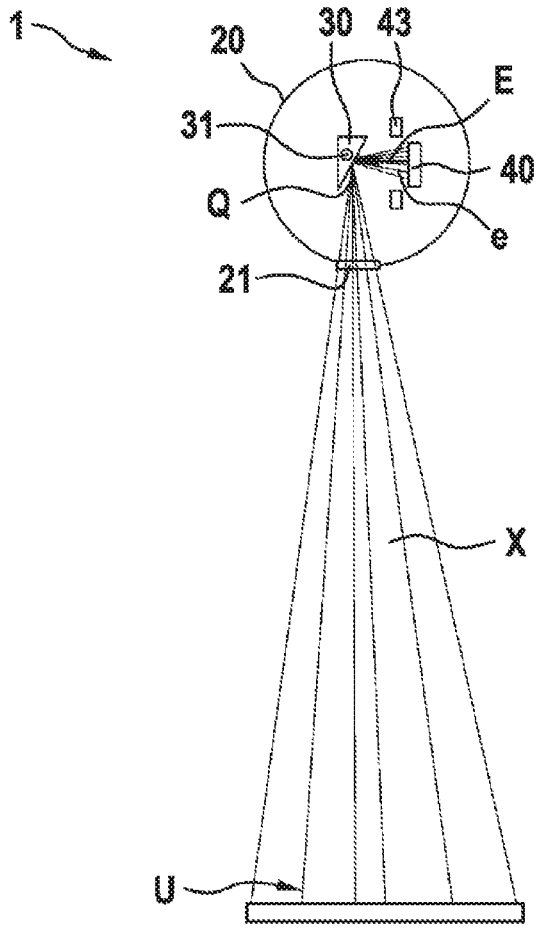
FIG. 2 shows the first embodiment example of a MBFEX tube 1 in a diagrammatic side view.

FIG. 2 shows the proposed MBFEX tube 1 in its first embodiment example in a side view in cross section. In FIG. 2, the coolant feed pipe 32, the cathode feed lines 50 and the high-voltage bushings 51, 52 cannot be seen. The cathodes 40 comprise, on their surface, multi-walled carbon nanotubes in a perpendicular preferential direction. "Perpendicular" in this context is understood to mean an orientation directed toward the anode 30.

The second embodiment example of the proposed MBFEX tube 1 is explained in further detail below in reference to FIG. 3 and FIG. 4. The second embodiment example differs from the first embodiment example only in that the anode 30 is of linear design.

Figure 3:
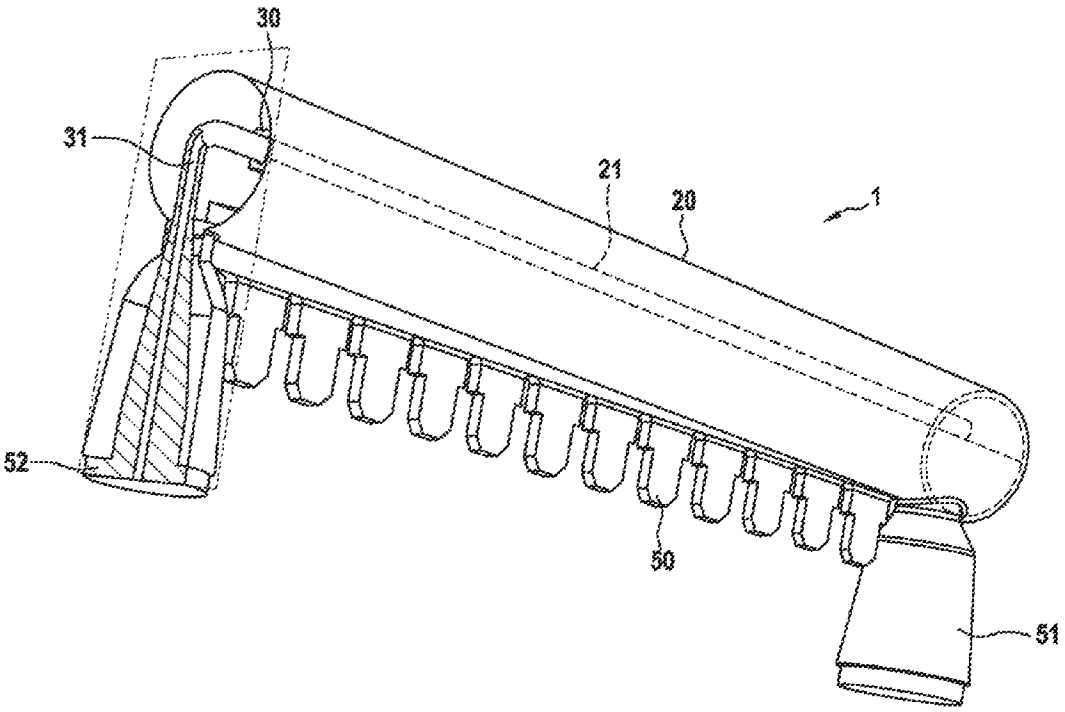
FIG. 3 shows a second embodiment example of a MBFEX tube 1 with an anode 30 of straight linear design.

FIG. 3 shows a partial section view onto the MBFEX tube 1 of the second embodiment example. In FIG. 3, the coolant feed pipe 32, the cathodes 40 and the grid devices 43 cannot be seen. As in the first embodiment example of the MBFEX tube 1, the cathode feed lines 50 and the high-voltage bushings 51, 52 are arranged in a row and lie opposite the anode 30 on the vacuum tube 20.

Figure 4:
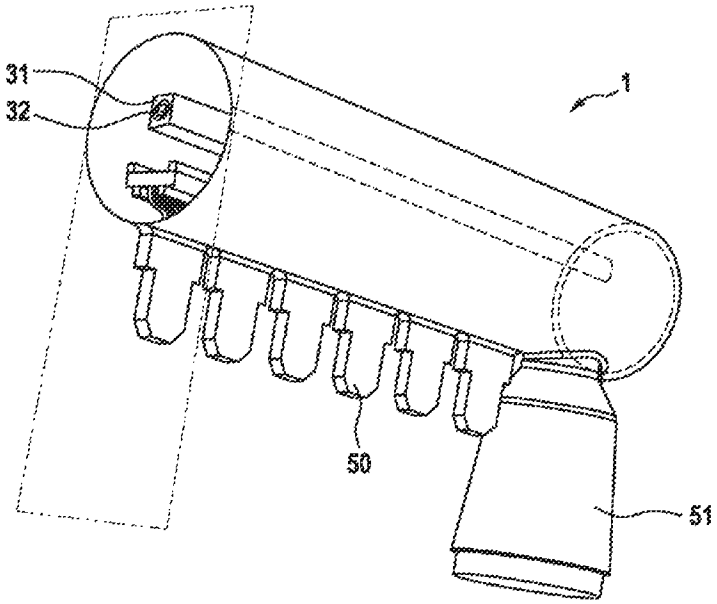
FIG. 4 shows the second embodiment example of a MBFEX tube 1 with a sectional view of the anode 30.
Figure 5:
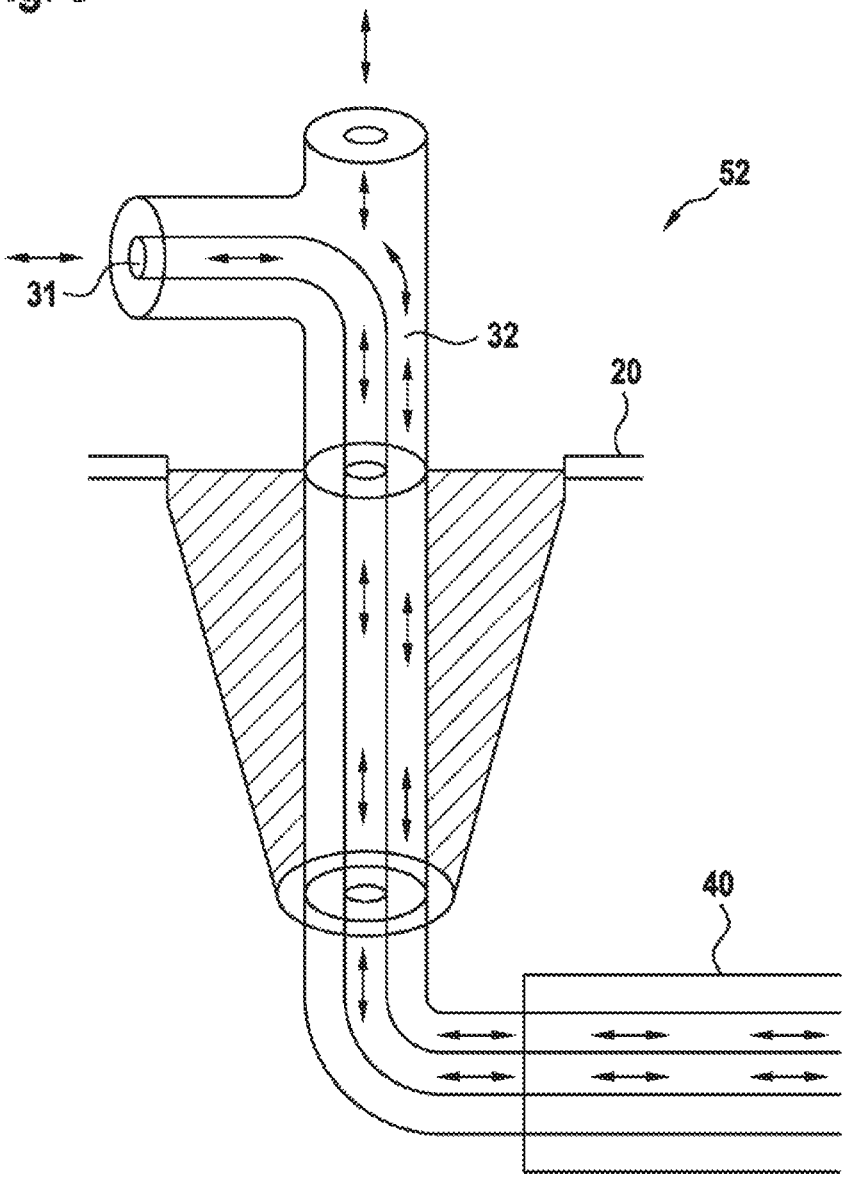
FIG. 5 shows a high-voltage bushing 52 of the MBFEX tube 1 according to FIG. 3.
Figure 7:
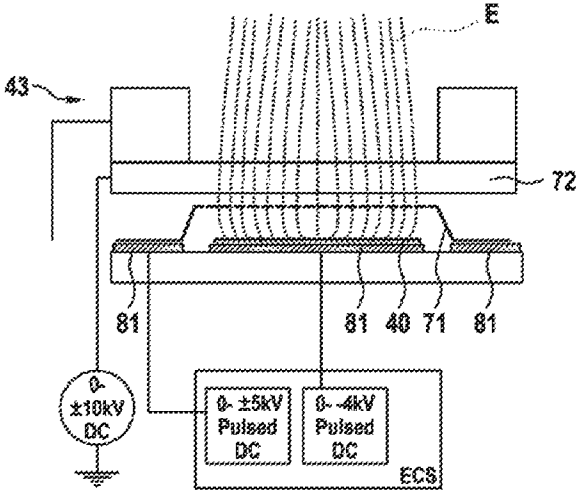
FIGS. 6, 7 show partial views of a grid device 43 of the MBFEX tube 1 of the first embodiment example of a computer tomograph.
Figure 6:
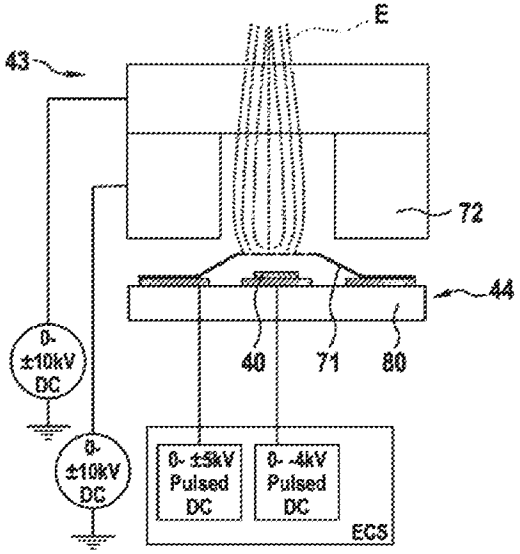
Figure 9:
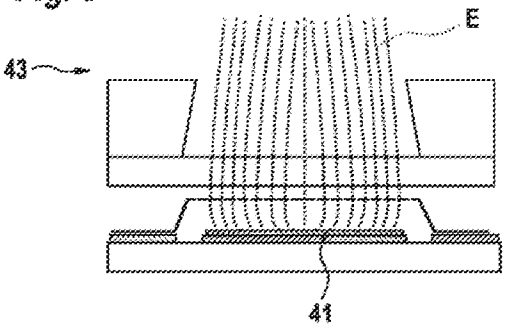
FIGS. 8, 9 show partial views of a grid device 43 of the MBFEX tube 1 of the second embodiment example of a computer tomograph.
Figure 11:
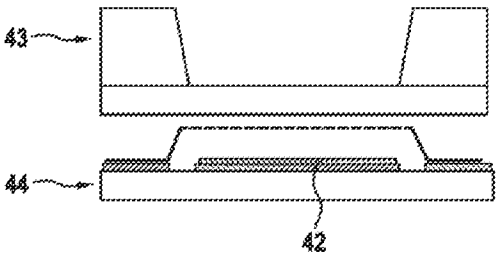
FIGS. 10, 11 show partial views of an alternative design of a grid device 43 of a MBFEX tube 1.
Figure 8:
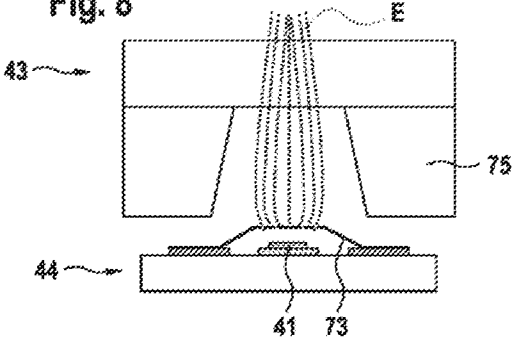
Figure 10:
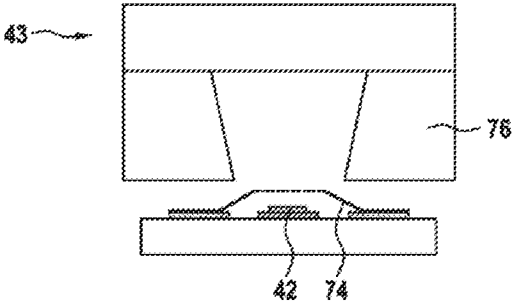
Figure 12:
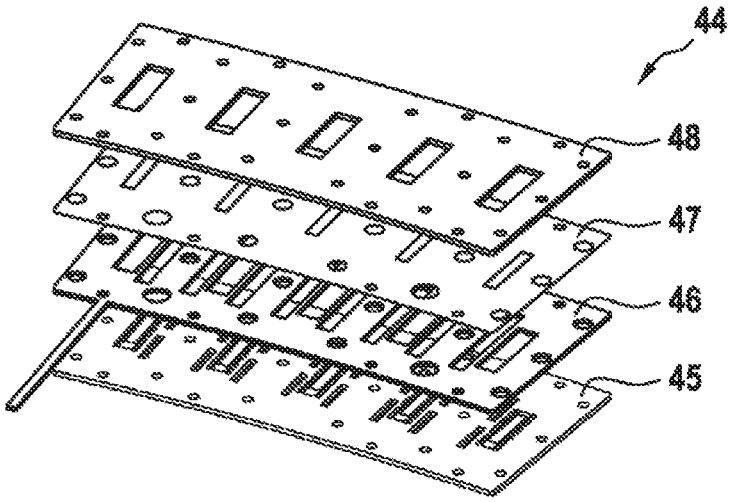
FIG. 12 shows an emitter arrangement 33 of a MBFEX tube 1 in an exploded representation.
Figure 13:
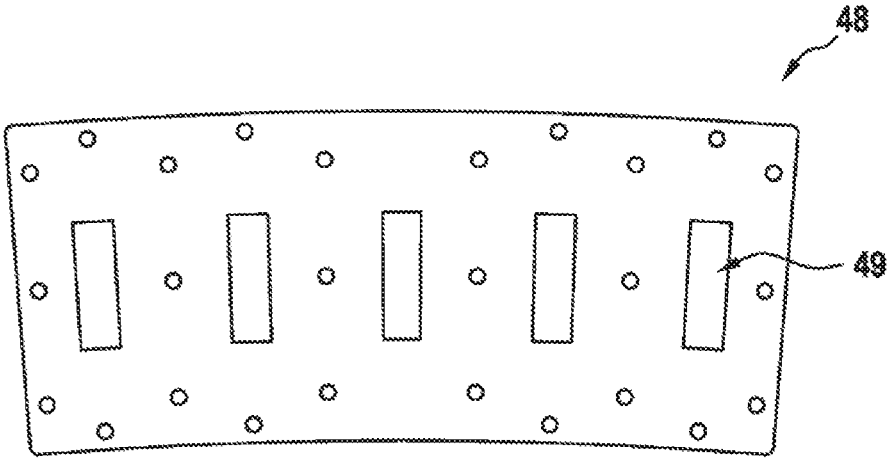
FIG. 13 shows an upper insulating layer 48 of the emitter arrangement 44 according to FIG. 12.
Figure 14:
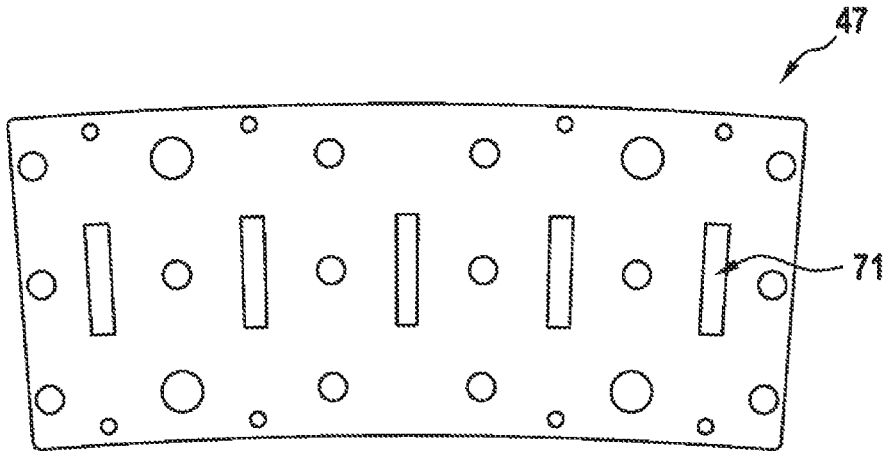
FIG. 14 shows a grid plate 47 of the emitter arrangement 44 according to FIG. 12.

FIG. 4 shows the proposed MBFEX tube 1 in its second embodiment example with a sectional view of the anode 30. In FIG. 3, the cathodes 40 and the grid devices 43 can also not be seen. Individual features of the high-voltage bushing 52 are apparent from FIG. 5.

A grid device 43 present in all the embodiment examples, which is represented in detail in different variants in FIGS. 5 to 11, is oriented toward the anode 6, that is to say arranged between the cathodes 40, 41, 42 and the anode 6 in the vacuum tube 20. The grid device 43 comprises by definition at least one extraction grid electrode 71, 73, 74 and at least one form of focusing electrodes 72, 75, 76.

The extraction grid electrodes 71, 73, 74 are securely arranged directly above the cathodes 40, 41, 42 and are provided for field extraction of electrons from the cathodes 40, 41, 42. The focusing electrodes 72, 75, 76 are also securely arranged above each extraction grid electrode 71, 73, 74, face the anode 6 and are provided for the focusing the extracted electrons as an electron beam E onto the respective x-ray source Q to be generated. The extraction grid electrodes 71, 73, 74 are grounded independently of focusing electrodes 72, 75, 76. The focusing electrodes 72, 75, 76 can be operated as passive or active focusing electrodes.

In the first embodiment example, the grid device 43 comprises an extraction grid electrode 71 common to all the cathodes 40, wherein an individual focusing electrode 72 is associated separately with each individual cathode 40. In the second embodiment example, the grid device 43 comprises an extraction grid electrode 73 of a first form, which is common to the cathodes 41 of the first type, and an extraction grid electrode 74 of a second form, which is common to the cathodes 42 of the second type, wherein in each case an individual focusing electrode 75 of a first form is separately associated with each individual cathode 41 of the first type, and in each case an individual focusing electrode 76 of a second form is associated with each individual cathode 42 of the second type. The extraction grid electrodes 71, 73, 74 and the focusing electrodes 72, 75, 76 are not drawn in FIGS. 1 to 4.

For a computer-assisted x-ray imaging by tomosynthesis, a temporally constant potential of typically 40 kV is applied to anode 6, wherein between the anode 6 and the respective switched cathode 40, 41, a uniform pulsed direct electric current of 30 mA flows. For computer-assisted x-ray imaging by HPEC tomosynthesis, on the other hand, on the anode in question, a temporally constant potential of typically 120 kV is applied, wherein, between the anode 6 and the respective switched cathode 40, 42, a common pulsed direct electric current of the order of magnitude of 0.5 mA flows.

In all the embodiment examples, the proposed computer tomograph comprises a current controller, a device control, an electronic control system (ECS=Electric Control System), a cathode high-voltage source (CPS=Cathode Power Supply), an anode high-voltage source (APS=Anode Power Supply), and a device control. The current controller, the device control, the electronic control system, the cathode high-voltage source, the anode high-voltage source and the device control are part of an electronic closed-loop control device. The current controller, the device control and the electronic control system represent an electronic control system.

The electronic closed-loop control device comprises an electric main circuit and a control loop, wherein the main circuit and the control loop are integrated in a direct-current circuit. In the main circuit, the anode high-voltage source is electrically connected to the anode 6 and the current controller, the current controller is electrically connected to the device control, the device control is electrically connected to the electronic control system, the electronic control system is electrically connected to the cathode high-voltage source, and the cathode high-voltage source is connected in parallel connection to the cathodes 40, 41, 42 and also to the respective grid device 43. In the control loop, the anode high-voltage source is electrically linked by feedback to the control system. Here, the control system can be provided both for the sequential switching of the cathodes 40, 41, 42, for the closed-loop control of the extraction grid electrodes 71, 73, 74, and of the focusing electrodes 72, 76, 56 of the respective grid device 43, and also for the closed-loop control of the main circuit current, wherein the electric voltage of the cathode high-voltage source can be adapted to the main circuit current predetermined by the control system.

In FIG. 21, as examples, eight cathodes 41, 42 of the MBFEX tube 1 are outlined. Both the cathodes 41 of the first type and also the cathodes 42 of the second type comprise carbon nanotubes that differ however by their geometry. The cathodes 41, 42 are arranged in the vacuum tube 20 in a row arrangement alternatingly offset, wherein the number of the cathodes 41 of the first type is equal to the number of the cathodes 42 of the second type. In each case, a cathode 41 of the first form and in each case a cathode 42 of the second form can be associated with a grid device 43 and thus with an x-ray source Q In the MBFEX tube 1 according to FIG. 21, the cathodes 41 of the first type or the cathodes 42 of the second type can be actuated sequentially as desired. In this manner, the dual dose x-ray image acquisitions with the MBFEX tube 1 can be implemented.

As is apparent from FIGS. 22 to 25, multiple MBFEX tubes 1 can be combined to form a rigid annular or polygonal arrangement which in a computer tomograph replaces a rotating arrangement. This applies to any design of MBFEX tubes 1 already described or to be explained below.

A layered structure of an emitter arrangement 44 of a MBFEX tube 1 is illustrated in FIGS. 12 to 20. The emitter arrangement 44 comprises, as lowermost layer, a ceramic plate 45 made of corundum. The cathodes 40 are located on a conductive coating of the ceramic plate 45 and are produced in the silk screen printing method with high geometric precision. On the back side of the ceramic plate 45, conductor structures 66 can be seen.

On the ceramic plate 45, a metal intermediate plate 46 is positioned. This metal intermediate plate 46 comprises rectangular openings 61 for the cathodes 40. In addition, in the metal intermediate plate 46, strip-shaped openings 62 which are smaller and longer in comparison to the openings 61 are located on the long sides of the openings 61. The strip-shaped openings 62 have a function of degassing the vacuum tube 20. This applies both to the preparation for the operation and also for the running operation of the x-ray tube 1, in each case in cooperation with the ceramic plate 45.

In the ceramic plate 45, in addition to the cathodes 40, different strip-shaped openings 64, 65 can be seen. Here, in each case, three short small openings 64 lie directly adjacent to the long sides of each cathode 40. In addition, the cathodes 40 are flanked by somewhat farther lying openings 65 which are also strip-shaped. Here, in each case, two strip-shaped openings 65 are arranged in a line one after the other. Two pairs of such lines of strip-shaped openings 65, together with the arrangement lying in between consisting of cathode 40 and a total of six smaller strip-shaped openings 64, overall describe an H-shape. This applies to all the cathodes 40 on the ceramic plate 45 with the exception of the two outermost cathodes 40 which are flanked only on one side by strip-shaped openings 65 of the longer type.

In particular the internal openings 64 which lie very close to the cathodes 40 here contribute to the fact that, during the emission of electrons, gas at an extremely low concentration of only a few particles can also be discharged toward the back side of the emitter arrangement 44. Thus, an essential contribution is made for preventing arcing within the vacuum tube 20. For removing gas by suctioning during the production of the x-ray tube 1, in particular during heating, the relatively large strip-shaped openings 65 are needed to a greater extent.

The metal intermediate plate 46 comprises as an integral part a connection strip 63 as an electric connection leading outward from the emitter arrangement 44. On the metal intermediate plate 46, a grid plate 47 is located, which encloses the extraction grid electrodes 71 which are each put in front of a cathode at an exactly defined spacing of 0.224 mm (in the example according to FIG. 12).

Figure 15:
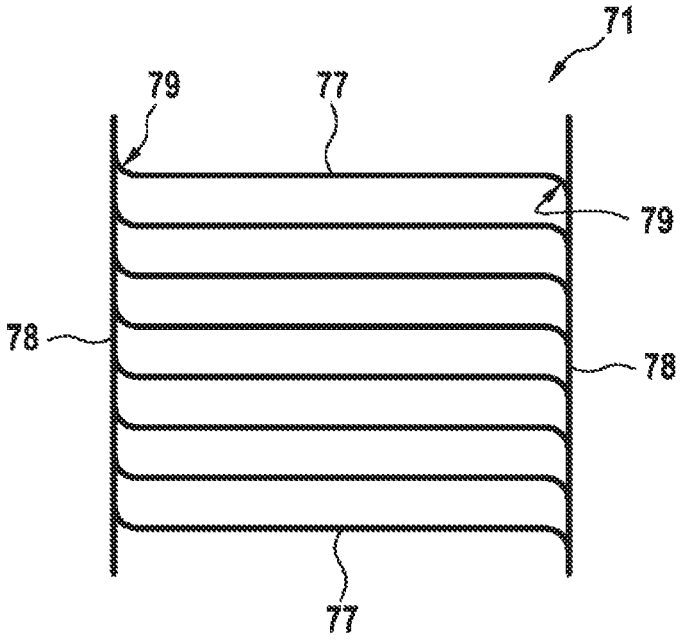
FIG. 15 shows an extraction grid electrode 71 of the grid plate 47 according to FIG. 14.
Figure 16:
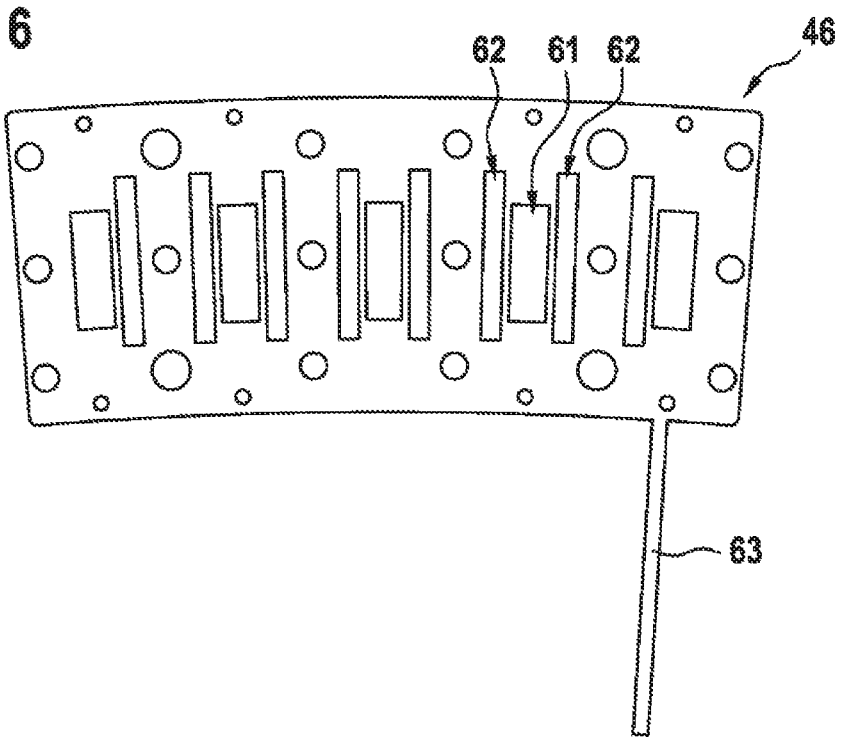
FIG. 16 shows a metal intermediate plate 46 of the emitter arrangement 44 according to FIG. 12.
Figure 17:
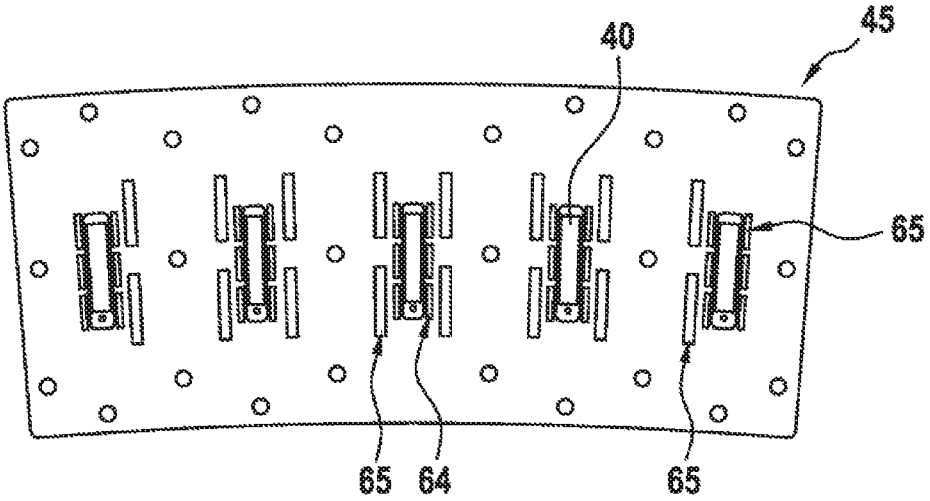
FIGS. 17, 18 show the front side of a ceramic plate 45 of the emitter arrangement 44 according to FIG. 12.
Figure 18:
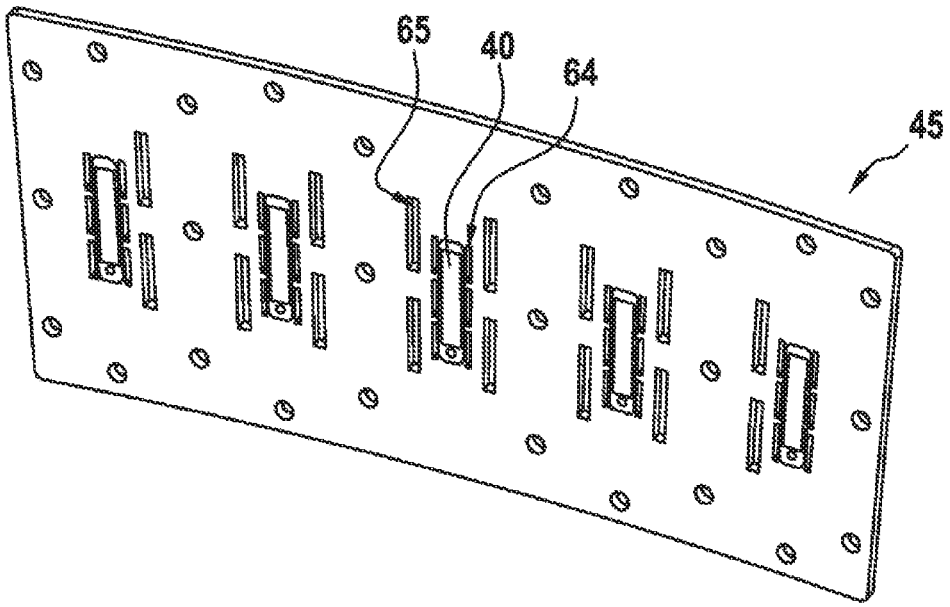
Figure 19:
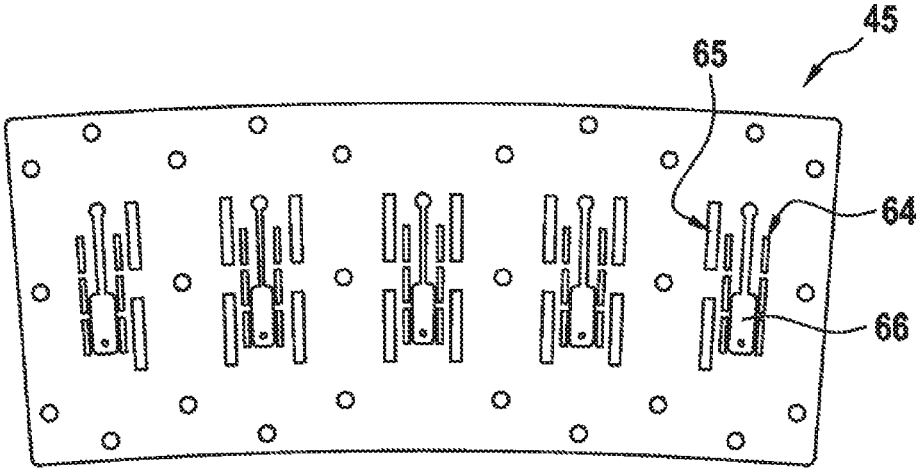
FIG. 19 shows the back side of the ceramic plate 45 of the emitter arrangement 44 according to FIG. 12.
Figure 20:
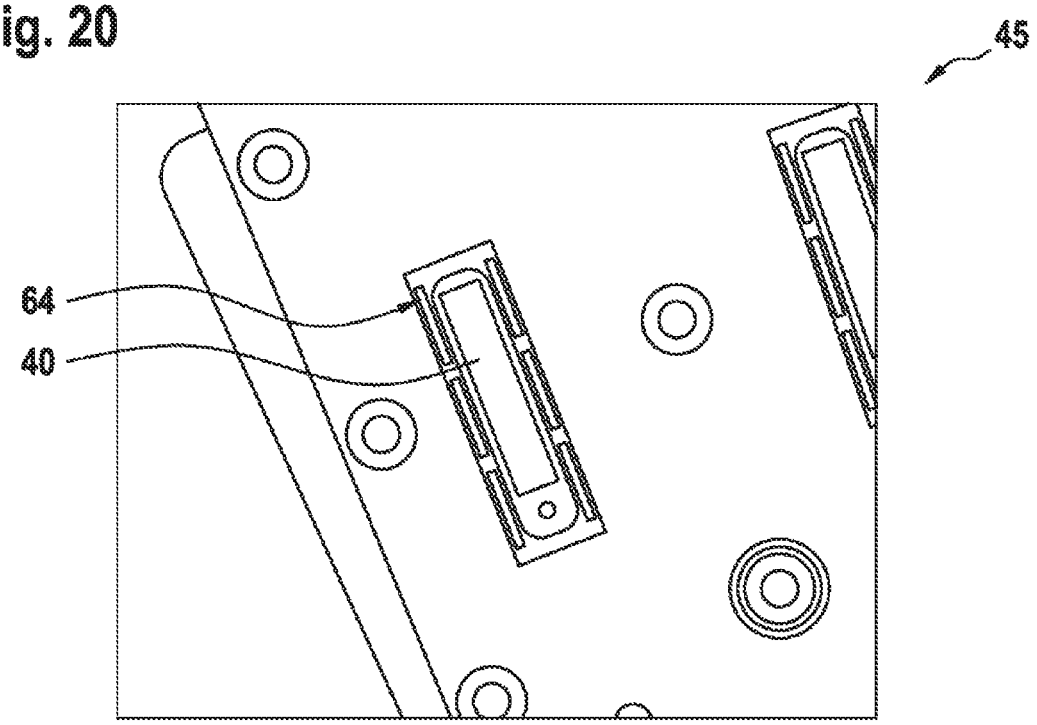
FIG. 20 shows a detail of the ceramic plate 45.

Details of the extraction grid electrode 71 are apparent from FIG. 15. Overall, the extraction grid electrode 71 has a rectangular form, the long sides of which are formed by completely straight edge strips 78. The two edge strips are connected to one another by a plurality of grid strips 77, resulting overall in the grid structure. However, in contrast to the edge strips 78, the grid strips 77 are not completely straight. Instead, at the two ends of each grid strip 77, that is to say at the transition to the edge strip 78, a rounded transition region 79 is formed. The rounded transition regions 79 essentially ensure that thermally caused deformations do not lead to a change in the spacing between the cathode 40 and the extraction grid 71, but instead are absorbed within the extraction grid 71 lying in a plane, without effects on the emission properties of the emitter arrangement 44.

The grid plate 47 is covered by an upper insulating layer 48 in the form of a plate made of a ceramic material, whereby the emitter arrangement 44 is completed. The upper insulating layer 48 comprises, as is apparent from FIG. 12, openings 49 which are adapted to the shape of the cathodes 40 in order to enable the passage of electrons.

Figure 28:
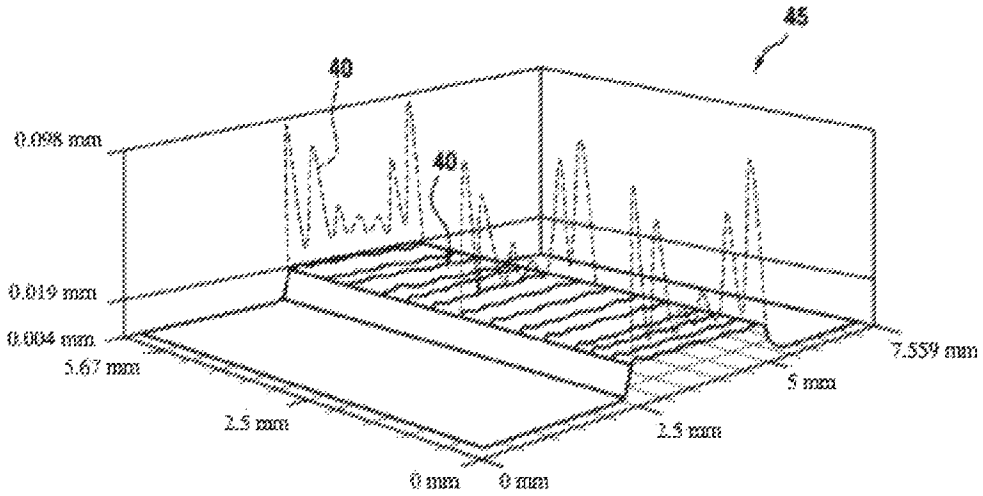
FIG. 28 shows, in a three-dimensional representation, the form of a cathode 40 of a MBFEX tube 1 as well as, for comparison, a conventional cathode form.

Geometric features of the cathode 40, as are repeatedly contained in the emitter arrangement 44, are represented in FIG. 28. With good approximation, the cathode 40 has a cuboid structure. Over the entire electron-emitting surface of the cathode 40, there are thus hardly any changes in the spacing between the cathode 40 and the extraction grid electrode 71 which is not drawn in FIG. 28. For comparison, FIG. 28 shows, drawn with a dashed line, the surface structure of a conventional cathode produced by the method of electrophoretic deposition (EPD). In this comparison example, one can no longer speak of a smooth surface. Instead, particularly at the edges of the cathode produced by the EPD method, there are pronounced points within the surface of the emission cathode. The electrons are emitted mainly at these points. This limits, on the one hand, the life span, and on the other hand, the transmission rate of electrons. In contrast, the cathode 40, as used in the x-ray tube 1 according to the invention, emits electrons in each surface section of its surface at a nearly constant release rate.

Figure 26:
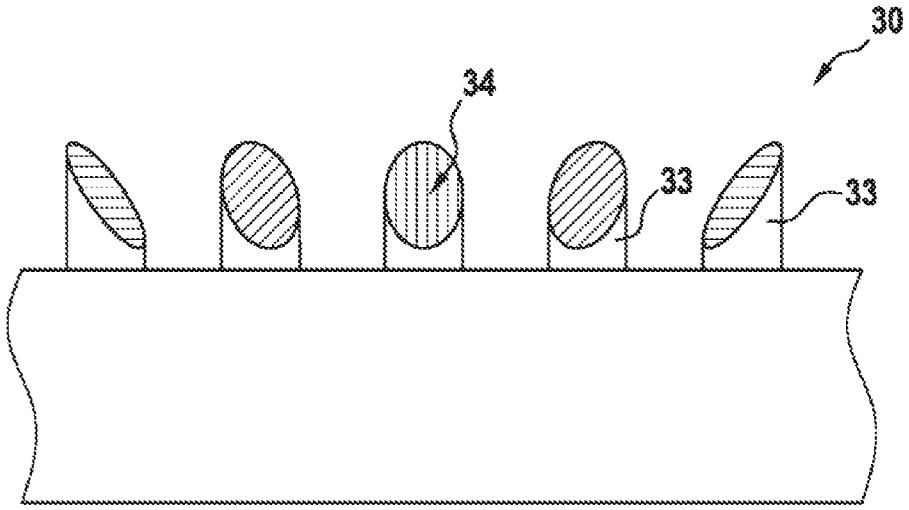
Figure 27:
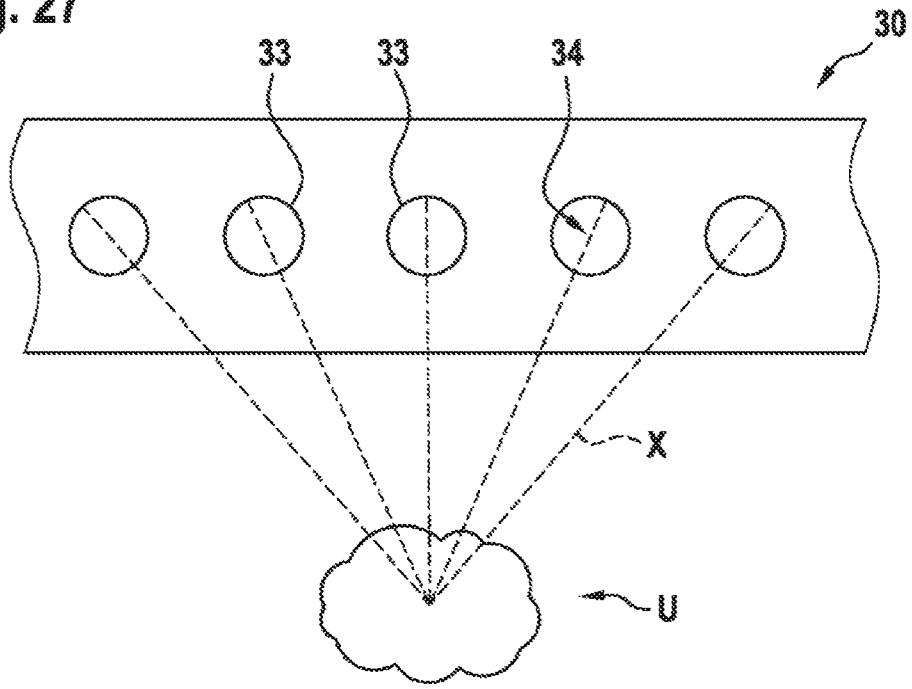

An embodiment example of an anode 30 cooperating with the emitter arrangement 44 is illustrated in FIGS. 26 and 27. On the cylindrical base body of the anode 30, multiple projecting pieces 33 are located, which are also referred to as anode projections or in brief as projections. Each of these projections 33 has a surface 34 which is slanted with respect to the base body and coated with tungsten or another material suitable for x-ray sources. The slants of the different surfaces 34 differ from one another in such a manner that—as indicated in FIG. 27—the emitted x-ray radiation X is focused in the direction of the isocenter of the x-ray arrangement 10 lying in the examination region U.

Although the structures, devices, methods, and systems have been described in accordance with particular embodiments, one of ordinary skill in the art will readily recognize that many variations to the particular embodiments are possible, and any variations should therefore be considered to be within the spirit and scope disclosed herein. Accordingly, many modifications may be made by one of ordinary skill in the art without departing from the spirit and scope of the appended claims.

The claims following this written disclosure are hereby expressly incorporated into the present written disclosure, with each claim standing on its own as a separate embodiment. This disclosure includes all permutations of the independent claims with their dependent claims. Moreover, additional embodiments capable of derivation from the independent and dependent claims that follow are also expressly incorporated into the present written description. These additional embodiments are determined by replacing the dependency of a given dependent claim with the phrase "any of the claims beginning with claim [x] and ending with the claim that immediately precedes this one," where the bracketed term "[x]" is replaced with the number of the most recently recited independent claim. For example, for the first claim set that begins with independent claim 1, claim 3 can depend from either of claims 1 and 2, with these separate dependencies yielding two distinct embodiments; claim 4 can depend from any one of claim 1, 2, or 3, with these separate dependencies yielding three distinct embodiments; claim 6 can depend from any one of claim 1, 2, 3, or 4, with these separate dependencies yielding four distinct embodiments; and so on.

Recitation in the claims of the term "first" with respect to a feature or element does not necessarily imply the existence of a second or additional such feature or element. Elements specifically recited in means-plus-function format, if any, are intended to be construed to cover the corresponding structure, material, or acts described herein and equivalents thereof in accordance with 35 U.S.C. § 112(f). Embodiments of the invention in which an exclusive property or privilege is claimed are defined as follows.

The invention claimed is:

1. A multibeam field emission X-ray (MBFEX) tube for an x-ray device which comprises, in a vacuum tube, an anode designed as a cooling finger and securely arranged in the vacuum tube, and a plurality of securely arranged cathodes, wherein the vacuum tube comprises a plurality of cathode feed lines and no more than two high-voltage bushings, in a high-voltage bushing a coolant pipe is passed through by an internal coolant inner pipe, the coolant pipe and the coolant inner pipe are provided for cooling the anode with a liquid coolant, the cathodes are provided for field emission of electrons and are in each case oriented toward the anode for generating x-ray sources.

2. The MBFEX tube of claim 1, wherein the cathode feed lines and the high-voltage bushings are arranged in a row and lying opposite the anode on the vacuum tube.

3. The MBFEX tube of claim 2, wherein the x-ray sources are arranged in a row arrangement on the anode.

4. The MBFEX tube of claim 3, wherein the x-ray sources are each located on a surface section of the anode which is slanted with respect to the center axis of the anode.

5. The MBFEX tube of claim 4, wherein the slanted surface sections are formed by at least one of projections of the anode or ground sections in the anode.

6. The MBFEX tube of claim 5, wherein the slanted surface sections are coated.

7. The MBFEX tube of claim 1, wherein the cathodes comprise nanorods.

8. The MBFEX tube of claim 7, wherein the nanorods are designed as at least one of single-walled carbon nanotubes, multi-walled carbon nanotubes, single-walled hetero nitrogen carbon nanotubes, or multi-walled hetero nitrogen carbon nanotubes.

9. The MBFEX tube of claim 7, wherein at least some of the nanorods contain at least one of rare earth borides, metal oxides, metal sulfides, nitrides, carbides or silicon.

10. The MBFEX tube of claim 7, wherein the nanorods have a length of less than 20 μm and a diameter of less than 10 nm, and wherein a density with respect to the surface area of the cathodes is at least $10^6$ nanorods per $cm^2$.

11. The MBFEX tube of claim 1, wherein focusing electrodes are arranged between at least one extraction grid, located above the cathodes, and the anode.

12. The MBFEX tube of claim 11, wherein the focusing electrodes are grounded separately from the extraction grid.

13. The MBFEX tube of claim 11, wherein at least one of the focusing electrodes and extraction grids are produced from steel.

14. The MBFEX tube of claim 11, wherein the extraction grid has a rectangular form with mutually parallel edge strips, which are connected to one another by grid strips to form a single piece, wherein, at the transitions between the grid strips and the edge strips, rounded transition regions are formed, with which the grid strips in each case has an elongate S form.

15. The MBFEX tube of claim 1, wherein the vacuum tube comprises different types of cathodes which differ by at least one parameter from a group of parameters, wherein the group of parameters comprises geometric parameters and material parameters.

16. The MBFEX tube of claim 1, wherein a layer designed for the emission of electrons having a thickness of less than 20 μm and an average roughness (Ra) of less than 2.5 μm is formed by at least one type of cathode.

17. The MBFEX tube of claim 1, wherein the plurality of cathodes is arranged on a flat support element.

18. The MBFEX tube of claim 17, wherein the flat support element comprises corundum.

19. The MBFEX tube of claim 17, wherein the flat support element comprises strip-shaped openings of a first type and strip-shaped openings of a second type, wherein a group of strip-shaped openings of the first type is arranged closer to a cathode than a group of strip-shaped openings of the second type, and wherein the strip-shaped openings of the first type are smaller than the strip-shaped openings of the second type.

20. The MBFEX tube of claim 17, wherein the flat support element is part of a layered emitter arrangement, which moreover comprises a metal intermediate plate, a grid plate including an extraction grid, as well as an upper insulating layer.

21. The MBFEX tube of claim 20, wherein strip-shaped openings of the flat support element are at least partially aligned with openings in the metal intermediate plate.

22. The MBFEX tube of claim 1, wherein the anode is designed for two-way feeding and discharging of coolant, wherein, at the two ends of the anode, in each case a coolant feed line and an associated coolant discharge line are arranged.

23. The MBFEX tube of claim 1, wherein the anode at least partially encloses an examination region, wherein the x-ray sources also at least partially surround the examination region.

24. The MBFEX tube of claim 23, wherein the anode has an arcuate design.

25. The MBFEX tube of claim 1, wherein the anode is designed as a rotating anode.

* * * * *